US008273698B2

(12) United States Patent
Arafat

(10) Patent No.: US 8,273,698 B2
(45) Date of Patent: Sep. 25, 2012

(54) SILOXANE COMPOSITIONS COMPRISING AN ALKYLATED CYCLOSILOXANE AND LINEAR ALKYLATED SILOXANE MIXTURE

(75) Inventor: El Sayed Arafat, Leonardtown, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/456,464

(22) Filed: Apr. 26, 2012

(65) Prior Publication Data

US 2012/0205588 A1 Aug. 16, 2012

Related U.S. Application Data

(63) Continuation-in-part of application No. 13/009,281, filed on Jan. 19, 2011, which is a continuation-in-part of application No. 12/639,476, filed on Dec. 16, 2009, now Pat. No. 7,897,558.

(51) Int. Cl.
*C11D 9/36* (2006.01)
*C11D 3/44* (2006.01)

(52) U.S. Cl. ..... 510/285; 510/276; 510/292; 510/304; 510/407; 510/432; 510/466

(58) Field of Classification Search ..... 510/276, 510/285, 292, 304, 407, 432, 466
See application file for complete search history.

(56) References Cited

U.S. PATENT DOCUMENTS

| | | | | |
|---|---|---|---|---|
| 5,977,040 | A * | 11/1999 | Inada et al. | 510/165 |
| 6,042,617 | A * | 3/2000 | Berndt | 8/142 |
| 2006/0128583 | A1* | 6/2006 | Evers et al. | 510/285 |
| 2006/0200914 | A1* | 9/2006 | Evers et al. | 8/142 |
| 2009/0053159 | A1* | 2/2009 | Brun | 424/70.12 |

FOREIGN PATENT DOCUMENTS

| | | | |
|---|---|---|---|
| EP | 0576687 | A1 | 1/1994 |
| EP | 0673996 | A2 | 9/1995 |
| GB | 2238793 | A | 6/1991 |
| WO | 0004222 | A1 | 1/2000 |
| WO | 2005068708 | A1 | 7/2005 |

OTHER PUBLICATIONS

Anonymous, NAVAIR Finds Alternatives for Petroleum-Based Solvents, Naval Air Systems Command (NAVAIR) Currents, Nov. 5, 2009, Retrieved from the Internet: URL:http://www.enviro-navair.navy.mil/currents/fall2009/Fall09_Alternatives_Petroleum_Solvents.pdf [retrieved on Apr. 26, 2012] the whole document.

* cited by examiner

*Primary Examiner* — Charles Boyer
(74) *Attorney, Agent, or Firm* — Mark O. Glut

(57) ABSTRACT

The present invention relates to siloxane compositions having a VOC of about 19 g/l, a flash point above 140° F., and a vapor pressure of less than seven millimeters of mercury (7 mm Hg). The siloxane compositions consist essentially of unsubstituted and/or alkylated cyclicsiloxanes having 5 or 6 silicon atoms, an alkylated cyclicsiloxane having 3 or 4 silicon atoms, a linear alkylated siloxane fluid, at least one alkylene glycol alkylether and an alkylene glycol having at least six carbon atoms.

19 Claims, 1 Drawing Sheet

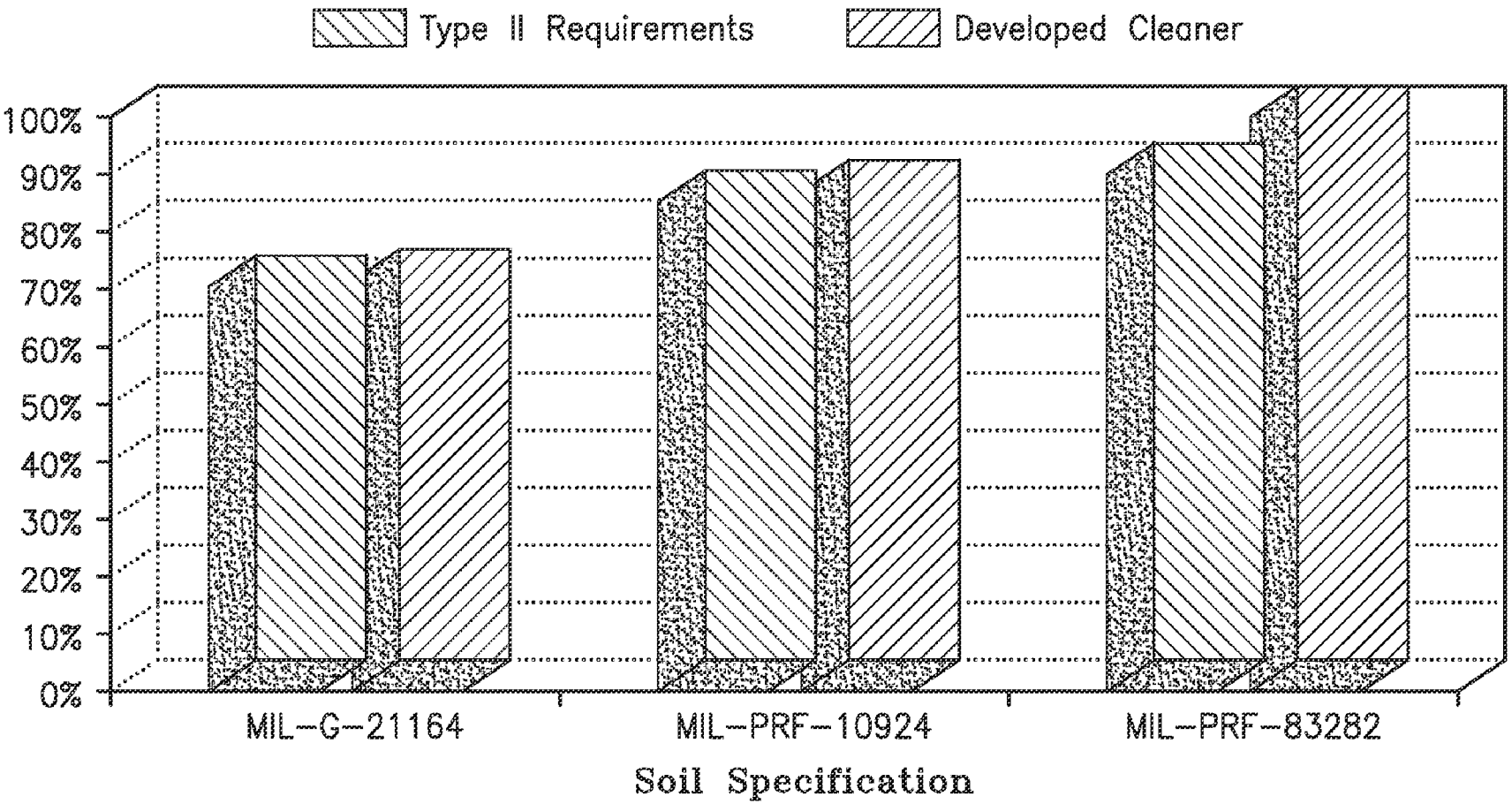
Type II Requirements
Developed Cleaner
100%
90%
80%
70%
60%
50%
40%
30%
20%
10%
0%
MIL-G-21164
MIL-PRF-10924
MIL-PRF-83282
Soil Specification

SILOXANE COMPOSITIONS COMPRISING AN ALKYLATED CYCLOSILOXANE AND LINEAR ALKYLATED SILOXANE MIXTURE

RELATED U.S. APPLICATION

This application is a continuation-in-part of co-pending application Ser. No. 13/009,281 filed on Jan. 19, 2011, which in turn is a continuation-in-part of application Ser. No. 12/639,476 filed Dec. 16, 2009, now U.S. Pat. No. 7,897,558 issued Mar. 1, 2011.

GOVERNMENT INTEREST

The invention described herein may be manufactured, licensed, and used by or for the U.S. Government.

FIELD OF THE INVENTION

This invention relates to the development of non-aqueous, low-VOC, HAP-free cleaner to meet new environmental regulation California (Rule 1171). VOCs are released during cleaning operations, contributing to the formation of ground-level ozone (photochemical smog), which can damage lung tissue, cause respiratory illness, and damage vegetation. Solvent emissions are regulated regionally and locally, with the air pollution control districts in California implementing the most stringent requirements. The South Coast Air Quality Management District (SCAQMD) has imposed restrictions limiting the VOC content in solvents to no greater than 25 grams per liter for immersion cleaning processes unless the solvent is used in an airtight cleaning system. In addition, under Title III of the 1990 Clean Air Act (CAA) amendments, the U.S. Environmental Protection Agency (EPA) established emissions standards for categories and subcategories of sources that emit or have the potential to emit listed HAPs. More specifically, this invention relates to cyclicsiloxane compositions and to methods of using said siloxane compositions which comprise a unique combination of two or more alkylated cyclic and linear siloxanes, alkylene glycols and glycolethers characterized as low-volatile siloxane compositions with flash points above 140° F. and vapor pressures of less than seven millimeters of mercury (7 mm Hg).

BACKGROUND

Solvent cleaners are known for their cleaning ability, quick drying, metal compatibility, and low surface tension to facilitate penetration. Unfortunately, most of these solvents are known also for the air pollution they cause regarding as volatile organic compounds or VOC), toxicity, flammability, and incompatibility with plastics. Moreover, the use of volatile organic compounds ("VOC") solvents has been discouraged due to their deleterious effect on the environment. Regulations have been promulgated to accelerate the phase-out of environmentally destructive solvents. The Environmental Protection Agency ("EPA") promulgates rules and regulations regarding environmental concerns such as VOCs. EPA has defined a VOC to include any volatile compound of carbon which participates in atmospheric photochemical reactivity. Thus, there is a need to reduce the use of conventional VOC solvents. It is apparent that a need exists for a solvent system which has little or no VOC content. The old specification P-D-680 solvent, commonly called Stoddard solvent or mineral spirits, contains petroleum fractions that are complex mixtures of mostly aliphatic hydrocarbons, but may contain some aromatics and olefinics. As such, P-D-680 contains hazardous air pollutants (HAPs) and VOCs, and causes health and environmental concerns. The revision to MIL-PRF-680 eliminated the HAPs but MIL-PRF-680 still covers a petroleum-based solvent containing the same amount of VOCs as P-D-680. These solvents have been specified for general cleaning to remove oil and grease from aircraft and engine components and from ground support equipment.

There are several alternatives to the MIL-PRF-680 solvents: water based, semi-aqueous, and solvent-based cleaners. Water-based cleaners contain detergents to remove grease and oil and may be used hot and/or with various forms of agitation (spray or ultrasonic). Disadvantages include flash rusting, embrittlement of high strength steel and poor cleaning efficiency. Semi-aqueous cleaning processes incorporate not only detergents, but also solvents to improve effectiveness. Some products contain solvents emulsified in water while other contain water-rinsable solvents. A significant disadvantage to semi-aqueous cleaners is their susceptibility to separation. Solvent-based cleaners, however, continue to be used in effective, low cost cleaning processes. In order to retain the capability of solvent cleaning, a new type of solvent is needed to meet the HAP and VOC requirements.

Under the proposed rule, MIL-PRF-680 will no longer be allowed in solvent degreasing operations in the SCAQMD. If a substitute material or process is not authorized, the Aircraft intermediate Maintenance Detachment (AIMD) at Lemoore and other maintenance facilities will not be able to perform specific maintenance requirements in accordance with NAVAIR technical manuals. Since MIL-PRF-680 is the only material authorized by the applicable maintenance manuals to clean flight critical parts, an approved alternative for MIL-PRF-680 was necessary to meet the new environmental regulations.

Specifically, solvent cleaning of aircraft components is performed at organizational, intermediate and depot levels and usually takes place in either spray sinks or batch loaded dip tanks. The primary solvent used for these applications has been P-D-680 Type II, which has a VOC content of more than 750 grams per liter (g/L). P-D-680 (A-A-59601) is a petroleum-based solvent, which contains hazardous air pollutants (HAPs) and volatile organic compounds (VOCs) which causes health and environmental problems. Its successor, MIL-PRF-680 is also a petroleum-based solvent which contains the same amount of VOC as P-D-680 but does not contain HAPs. Alternative processes, to eliminate VOC emission are immersion cleaning with cold or hot water-based products, heated high-pressure spray washing using water-based products, and exempt solvent cleaning. Water-based processes are often ineffective on heavy soils and can result in flash rusting of steel components.

To meet the new environmental regulations, NAVAIR Patuxent River developed a specification MIL-PRF-32295A (Cleaner, Non-Aqueous, Low-VOC, HAP-Free). The new specification consists of three types: Type I is intended for cleaning light soils such as oils and hydraulic fluids, Type II is intended for cleaning heavy soils such as greases and carbon residue, and Type III is intended fbr wipe cleaning applications. Three products have met the qualification requirements of MIL-PRF-32295A Type I specification. Currently, Type I qualified products are listed in NAVAIR 01-IA-509 Manual (Cleaning and Corrosion Control Manual) for cleaning aircraft applications. The cyclicsiloxane compositions of this invention qualify to be used to clean weapon systems across DoD maintenance facilities as an alternative to MIL-PRF-680.

SUMMARY OF THE INVENTION

The present invention relates to cyclic or cyclosiloxane compositions characterized as low-volatile organic solvents.

The low-volatile organic solvents consist essentially of a unique combination of at least one or more substituted or alkylated cyclosiloxanes having 5 or 6 silicon atoms and at least one substituted or alkylated cyclosiloxane having 3 or 4 silicon atoms. In addition to the cyclosiloxanes, the composition has at least one substituted or alkylated linear siloxane having 3 to 8 silicon atoms, at least one alkylene alkylether, and an alkylene glycol that must have at least 6 alkylene carbon atoms. These cyclosiloxane compositions are specifically characterized as having a VOC of about 19 g/l, a flash point above 140° F. and a vapor pressure of less than 70 millimeters of mercury (mm.Hg).

BRIEF DESCRIPTION OF THE DRAWING

FIG. 1 is a graphical representation of the cleaning efficiency test results for Navsolve in accordance with MIL-PRF-32295A Type II Specification.

DETAILED DESCRIPTION OF THE INVENTION

The present invention relates to linear and cyclosiloxane compositions consisting essentially of low-volatile (low-VOC) compounds. These cyclosiloxane compositions are characterized particularly as having a flash point above 140° F., and a vapor pressure of less than 7.0 millimeters of mercury (7 mmHg). The siloxane is a chain or ring composed of alternating silicon and oxygen atoms that can be unsubstituted or alkylated with alkyl groups of 1 to 10 carbons.

Specifically, the siloxane compositions of this invention consist essentially of from about 40 to 80 parts by weight of at least one alkylated cyclosiloxane having 5 or 6 silicon atoms, about 20 to 50 parts by weight of at least one alkylated cyclosiloxane having 3 or 4 silicon atoms, about 1.0 to 10 parts by weight of a linear alkylated siloxane having 3 to 8 silicon atoms, about 1.0 to 5.0 or 1 to 3 parts by weight of at least one alkylene glycol alkylether, and more important from about 0.1 to 2.0 or 0.1 to 1.0 parts by weight of a higher molecular weight alkylene glycol having 6 or more carbon atoms.

Preferably, the siloxane compositions of this invention must have low VOC's, flash points above 140° F., with a vapor pressure of less than 7.0 millimeters of mercury (7 mm Hg) and consist essentially of from about 60 to 70 parts by weight of an alkylated cyclosiloxane having 5 silicone atoms wherein the alkyl substituents of the siloxane has a total of 10 carbon atoms, about 25 to 40 parts by weight of an alkylated cyclosiloxane having 4 silicon atoms wherein the alkyl substituents of the siloxane has a total of 8 carbon atoms, about 1.0 to 10 parts by weight of a linear alkylated siloxane having 3 to 8 silicon atoms, about 1.0 to 3.0 parts by weight of at least one alkylene glycol alkylether wherein said alkyl substituents have 1 to 6 carbon atoms and from about 0.1 to 1.0 part by weight of an alkylene glycol having at least six carbons.

Typical examples of alkyl substituted cyclosiloxanes having either 3 or 4 silicon atoms and cyclosiloxanes having either 5 or 6 silicon atoms include, for example, alkylated cyclic siloxanes wherein the alkyl groups are linear and/or branched and contain from 1 to 112 carbons and preferably each of the alkyl group of the polysiloxanes have 1 to 4 carbons. Examples include tetramethylcyclotetrasiloxane, tetraethylcyclotetrasiloxane, pentaethylcyclopentasiloxane, octamethyl-cyclotetrasiloxane, decamethyl pentacyclosiloxane, tetramethylcyclotrisiloxane, hexamethylcyclohexasitoxane and dimethyl cyclotrisitoxanes. Particularly suitable is the mixture or combination of octamethylcyclotetrasiloxane, decamethylcyclopentasiloxane and decamethyl linear tetrasiloxane fluid in combination with an alkylene glycol alkyl ether such as dipropylene or diethylene glycol monoalkyl ethers wherein the alkyl group has 1 to 4 or 1 to 6 carbons with small but effective amounts of at least one alkylene glycol that should have at least 6 carbon atoms in order for the siloxane compositions to have a low VOC with a flash paint above 140° F. and a vapor pressure of less than 7 mm. Hg. The alkylene glycol alkylethers preferably include the monoalkyl ethers of dipropylene glycol, triethylene glycol and tetraethylene glycol wherein the alkyl groups have 1 to 6 or 1 to 4 carbons. Other molecular weight alkylene glycol alkyl ethers include polyethylene or polypropylene glycol alkylethers wherein the alkyl group of the ether has from 1 to 10 branched or linear carbon atoms.

The following examples illustrate the cyclosiloxane compositions of this invention.

Example 1

| | Parts by Weight |
|---|---|
| Decamethylpentacyclosiloxane | 53.4 |
| Octamethyltetracyclosiloxane | 38 |
| Decamethyl linear tetrasiloxane | 5.7 |
| Dipropylene glycol n-butyl ether | 2.5 |
| Hexylene glycol | 0.4 |

Example 2

| | Parts by Weight |
|---|---|
| Decamethylpentacyclosiloxane | 60 to 70 |
| Octamethyltetracyclosiloxane | 25 to 40 |
| Linear tetrasiloxane fluid | 4 to 8 |
| Dipropylene glycol butylether | 1.0 to 3 |
| Hexylene glycol | 0.1 to 1.0 |

Example 3

| | Parts by Weight |
|---|---|
| Alkylpentacyclo siloxanes | 40 to 80 |
| Alkyltetracyclo siloxanes | 20 to 50 |
| Alkyl linear tetrasiloxanes | 1.0 to 10 |
| Alkyleneglycol alkyl ethers | 1.0 to 5 |
| Alkylene glycols of at least 6 carbons | 0.1 to 2.0 |

Properties of the Cyclosiloxane Compositions of the Invention

Cleaning Efficiency

The cleaning efficiency test thr the alkylates cyclosiloxane compositions (Navsolve cleaner) of this invention was conducted in accordance with MIL-PRE-32295A specification as shown in FIG. 1.

Preparation of Test Specimens

Stainless steel coupons 1 by 2 by 0.05 inches (25 by 50 by 1.3 mm) was polished with 240 grit aluminum oxide abrasive paper or cloth and solvent wiped with isopropyl alcohol. Coupons were weighed (weight−W1), coated on one side with 20-25 mg of soil, then reweighed (weight=W2). Soils tested were as follows:

a. MIL-G-21164 (grease, molybdenum disulfide, for low and high temp)

b. MIL-PRF-83282 (hydraulic fluid, fire resistant, synthetic hydrocarbon)

c. MIL-PRF-10924 (grease, automotive and artillery)

Test Procedure

Fresh solvent was used for each soil tested. Each test coupon was cyclically immersed and withdrawn from a 150-ml beaker containing 100 ml of the cleaner at a rate of 20 cycles per minute for 5 minutes. Each coupon dried for 10 minutes at 140=4° F. (60=2° C.), cooled to room temperature, and reweighed (weight=W3). Cleaning efficiency for the cleaner was calculated as follows for each coupon:

$$\% \text{ Cleaning efficiency} = (W2 - W3)/(W2 - W1) \times 100$$

The test result for each soil is the average of three coupon cleaning efficiencies.

TABLE 1

| Soil/Product | Requirements MIL-PRF-32295A Type II | Navsolve |
|---|---|---|
| MIL-G-21164 | 70% | 72% |
| MIL-PRF-10924 | 85% | 88% |
| MIL-PRF-83282 | 95% | 99% |

FIG. (1). Clearly shows the improved cleaning efficiency test results for Navsolve (MIL-PRF-83282) in Accordance with MIL-PRF-32295A Type II Specification.

Effect on Plastics (Crazing Test)

The effect of the developed Navsolve cleaner on plastics was conducted in accordance with the ASTM F484 and showed the following results.

| | |
|---|---|
| Acrylic, Type A & C | (no crazing) |
| Polycarbonate, AMS-P-83310 | (no crazing after 2 hours at 2000 psi) |

Flash Point

The flash point of flammable liquid is the lowest temperature at which it can form an ignitable mixture in air. The flash point for Navsolve cleaner was measured in accordance with MIL-PRF-32295A specification (ASTM D-56) and found as 141° F. To avoid the flammability problem, the flash point for the solvent must be 140° F. or higher. The flash point property is essential for solvent cleaner selection to ensure worker safety and health protection.

While some preferred embodiments have been disclosed there are other modifications and variations that can be practiced without departing from the scope of the appended claims.

The invention claimed is:

1. A siloxane composition having a low VOC, a flash point above 140° F., and a vapor pressure of less than 7.00 millimeters of mercury (7 mm Hg) consisting essentially of:

a) about 40 to 80 parts by weight of at least one alkylated cyclosiloxane having 5 or 6 silicon atoms;

b) about 20 to 50 parts by weight of at least one alkylated cyclosiloxane having 3 or 4 silicon atoms;

c) about 1.0 to 10 parts by weight of a linear alkylated siloxane having 3 to 8 silicon atoms;

d) about 1.0 to 5.0 parts by weight of at least one alkylene glycol alkylether; and e) about 0.1 to 2.0 parts by weight of an alkylene glycol.

2. The siloxane composition of claim 1 wherein the alkyl group of the alkylene glycol alkylether has 1-6 carbon atoms.

3. The siloxane composition of claim 1 wherein the 40 to 80 parts of the alkylated cyclosiloxane has 5 silicon atoms.

4. The siloxane composition of claim 1 wherein the 20 to 50 parts of the cyclosiloxane has 4 silicon atoms.

5. The siloxane composition of claim 1 wherein each of the alkylated substituents of the cyclosiloxanes have 1 to 4 carbon atoms.

6. The siloxane composition of claim 1 wherein each of the alkylated substituents of the siloxanes are methyl substituents.

7. The siloxane composition of claim 2 wherein the glycol alkylether is dipropylene glycol butylether.

8. A siloxane composition having a low VOC, a flash point above 140° F., and a vapor pressure of less than 7.0 millimeters of mercury (7 mm Hg) consisting essentially of:

a) about 60 to 70 parts by weight of an alkylated cyclosiloxane having 5 silicone atoms wherein the alkyl substituent of the siloxane has 10 carbon atoms;

b) about 25 to 40 parts by weight of an alkylated cyclosiloxane having 4 silicon atoms wherein the alkyl substituent of the siloxane has 8 carbon atoms;

c) about 4 to 8 parts by weight of a linear alkylated siloxane having 4 silicon atoms;

d) about 1.0 to 3.0 parts by weight of at least one alkylene glycol alkylether wherein said alkyl substituents have from 1 to 4 carbon atoms; and e) from about 0.1 to 1.0 parts by weight of an alkylene glycol having at least 6 carbons.

9. The siloxane composition of claim 8 wherein said cyclosiloxane having 5 silicon atoms is decamethylpentacyclosiloxane.

10. The siloxane composition of claim 8 wherein said cyclosiloxane having 4 silicon atoms is octamethyltetracyclosiloxane.

11. The siloxane composition of claim 8 wherein said alkylene glycol is hexylene glycol.

12. The siloxane composition of claim 8 wherein the alkylated substituents of said siloxanes are derived from alkyl compounds that are either the same or different and have branched or linear carbon atoms.

13. A siloxane composition having a low VOC, a flash point above 140° F., and a vapor pressure of less than seven millimeters of mercury (7 mm Hg) consisting essentially of:

a) about 53.4 parts by weight of an alkylated cyclosiloxane having 5 silicon atoms wherein the alkylated substituents of the siloxane has 10 carbon atoms;

b) about 38 parts by weight of at least one alkylated cyclosiloxane having 4 silicon atoms wherein the alkylated substituents of the siloxane has 8 carbon atoms;

c) about 5.7 parts by weight of a linear decamethyltetrasiloxane;

d) about 2.5 parts by weight of dipropylene glycol butyl ether; and e) 0.4 parts by weight of hexyleneglycol.

14. The siloxane composition of claim 3 wherein each alkyl group of the alkylated pentacyclosiloxanes is a methyl group.

15. The siloxane composition of claim 4 wherein each alkyl group of the alkylated tetracyclosiloxane is a methyl group.

16. The siloxane composition of claim 1 wherein the linear alkylated siloxane has a total of 10 alkyl carbons.

17. The siloxane composition of claim 1 wherein the alkyl substituents of said siloxanes have total of 8 to 10 linear and branched carbon atoms.

18. The siloxane composition claim 1 wherein the alkylated substituents of the siloxanes are derived from alkyl compounds that are either the same or different and are branched and/or linear carbon atoms.

19. The siloxane composition of claim 1 wherein each of the alkylated siloxane substituents have 1 or 2 linear carbon atoms.

* * * * *